United States Patent [19]

Saijo

[11] Patent Number: 4,545,634

[45] Date of Patent: Oct. 8, 1985

[54] MULTI-CONTACT CONNECTOR

[75] Inventor: Yoshihiro Saijo, Ibaragishi, Japan

[73] Assignee: Nippon Achakutanshi Seizo Kabushiki Kaisha, Osaka, Japan

[21] Appl. No.: 451,091

[22] Filed: Dec. 20, 1982

[30] Foreign Application Priority Data

Dec. 19, 1981 [JP] Japan ..... 56-190058[U]

[51] Int. Cl.[4] ..... H01R 11/20; H01R 13/50; H01R 13/58

[52] U.S. Cl. ..... 339/97 P; 339/17 C; 339/176 M; 339/217 R; 339/223 R

[58] Field of Search ..... 339/97 R, 97 P, 98, 339/99 R, 17 R, 17 C, 176 M, 217 R, 223

[56] References Cited

U.S. PATENT DOCUMENTS

| | | | |
|---|---|---|---|
| 3,963,319 | 6/1976 | Schumacher et al. | 339/99 R X |
| 3,993,391 | 11/1976 | Vernerey et al. | 339/97 R |
| 4,074,929 | 2/1978 | Krider | 339/97 R |
| 4,231,632 | 11/1980 | Badoz et al. | 339/97 R |
| 4,405,193 | 9/1983 | Weidler | 339/99 R |

*Primary Examiner*—Gil Weidenfeld
*Assistant Examiner*—Steven C. Bishop
*Attorney, Agent, or Firm*—Antonelli, Terry & Wands

[57] ABSTRACT

A multi-contact connector assembly for electrically connecting a plurality of electrical conductors such as insulation clad wires to an electrical device such as, for example, a printed circuit board. The multi-contact type connector includes an open top housing for enabling a number of the contacts to be accommodated therein. Each of the contacts includes a connecting section enabling an electrical connection with the printed circuit board and a wire holding section in which the insulation clad wire is held in an electrically conductive manner to the respective contacts. The wire holding section includes first and second walls having aligned slots therein, with a construction being provided for preventing the first slotted wall from bending sideways or laterally when the insulation clad wire is inserted into the slot therein. A housing is provided which includes additional slots aligned with the first and second slots, with the additional slots being disposed in the rear wall of a housing and accommodating the insulation clad wire. Further openings are provided in the front wall of the housing for enabling the connecting sections to extend therethrough.

11 Claims, 8 Drawing Figures

MULTI-CONTACT CONNECTOR

The present invention relates to an electrical connector and, more particularly, to a multi-contact electrical connector adapted to electrically connect a plurality of wires to a printed circuit board.

So-called multi-contact connectors or terminals for effecting electrical contact with a plurality of wires have found wide spread use and, for example, in U.S. Pat. Nos. 4,046,446 and 4,261,629, terminals of the aforementioned type are proposed. In these proposed constructions, one or more slots are generally provided for accommodating the respective wires, with some other means or device being necessary to hold the respective wires firmly in the one or more slots.

A disadvantage of the previously proposed multi-contact connectors resides in the fact that the individual wires are subject to torsion forces which readily results in an electrical disconnection between the wires and connectors thereby resulting in faulty electrical terminals fatally effecting the function of the printed circuit board to which the wires are connected.

The aim underlying the present invention essentially resides in providing a multi-contact connector capable of establishing a permanent firm electrical connection between the connector and the wires regardless of the effects of any torsional forces acting on the respective connectors.

In accordance with advantageous features of the present invention, a multi-contact connector is provided which includes an open topped housing of an insulating material for allowing the contacts to be accommodated or loaded therein. Advantageously, each of the contacts includes a connecting section whereby the contacts are electrically connected to the same printed circuit board. Moreover, a wire holding section is provided in which an insulation clad wire is held in an electrically conductive manner to the contacts.

In accordance with further features of the present invention, the wire holding section includes first and second slotted or grooved walls spaced apart from each other in such a manner that the first and second defined slots are aligned along the length of the wire. The first slotted wall advantageously includes means for preventing the slotted wall from expanding sideways or laterally when the wire is inserted in the first slot which means may, for example, including projecting ears engaged in recesses produced in the side walls of the contact.

In order to ensure a firm coupling of the contact to a housing of the multi-contact connector, in accordance with still further features of the present invention, the contact is provided with engaging pawls which ensure a firm coupling to the housing.

The housing of the multi-contact connector advantageous includes a number of third slots in a rear wall thereof with the number corresponding to the number of contacts. The third slots are advantageously aligned with the first and second slots in the contact and, a corresponding number of openings or the like are provided in the front wall through which the connecting sections of the contacts protrude.

Preferably, each of the third slots includes a recess or groove opening downwardly so as to allow the wire to be inserted through the third slot and to rest or be accommodated therein.

Advantageously, each contact of the multi-contact connector of the present invention is fashioned of a one piece body stamped from a sheet material such as a sheet of metal.

In accordance with still further advantageous features of the present invention, the housing includes recesses which are adapted to receive tail portions of the contacts loaded therein so as to secure the contacts in the housing.

Accordingly, it is an object of the present invention to provide a multi-contact electrical connector for enabling an electrical connection or a plurality of wires to a printed circuit board which avoids, by simple means, shortcomings and disadvantages encountered in the prior art.

Another object of the present invention resides in providing a multi-contact connector for enabling an electrical connection of a plurality of wires to a printed circuit board which minimizes if not avoids the adverse effects of torsional forces acting upon the individual wires.

A still further object of the present invention resides in providing a multi-contact electrical connector for enabling an electrical connection of a plurality of wires to printed circuit boards which is simple in construction and therefore relatively inexpensive to manufacture.

Yet another object of the present invention resides in providing a multi-contact electrical connector having contacts accommodated in a housing so as to protect the same against detrimental external forces.

A still further object of the present invention resides in providing a multi-contact electrical connector which ensures the continuance of a firm connection between contacts of the connector and associated wires.

Yet another object of the present invention resides in providing a multi-contact electrical connector which is of relatively small size but which is relatively rugged in construction and capable of withstanding external forces acting thereon.

A still further object of the present invention resides in providing a multi-contact connector which is of an extremely compact construction even when a plurality of contact bodies are assembled in one housing so as to form a multi-contact connector.

These and other objects, features, and advantages of the present invention will become more apparent from the following description when taken in connection with the accompanying drawings which show, for the purposes of illustration only, one embodiment in accordance with the present invention, and wherein.

Figure 1:
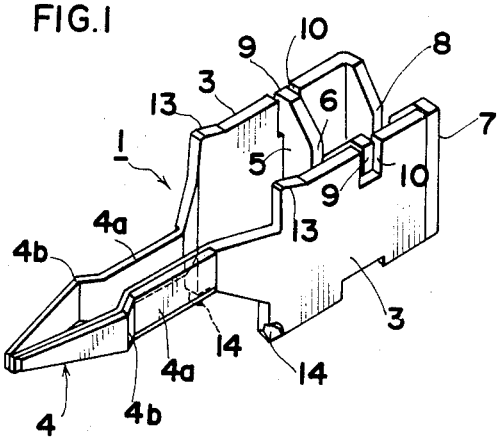
FIG. 1 is a perspective view of a contact adapted to be loaded in a multi-contact connector constructed in accordance with the present invention.
Figure 2:
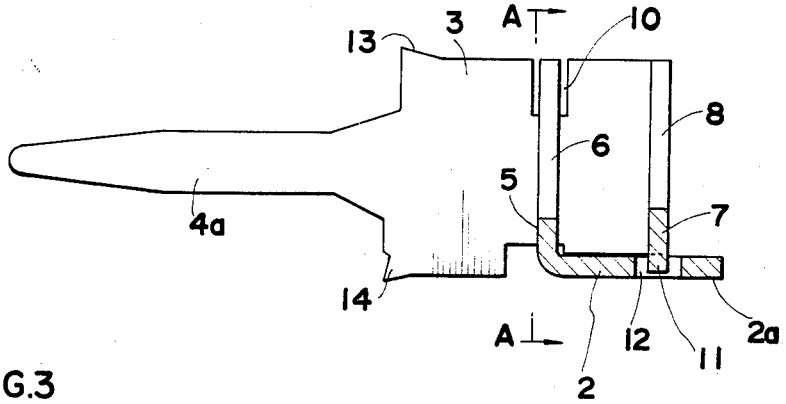
FIG. 2 is a vertical cross sectional view through the contact of FIG. 1.

Referring now to the drawings wherein like reference numerals are used throughout the various views to designate like parts and, more particularly, to FIGS. 1–4, according to these figures, a contact body generally designated by the reference numeral 1 is manufactured by, for example, a stamping or punching operation whereby the contact body 1 is produced from a metal sheet M of electrical conductivity. The contact body 1 includes a bottom wall 2 and side walls 3 erected or extending from the bottom wall 2. Each of the side walls 3 includes a tongue 4*a* extending in a forward direction. The two tongues 4*a* of the contact body 1 form a connecting section generally designated by the reference numeral 4.

Figure 3:
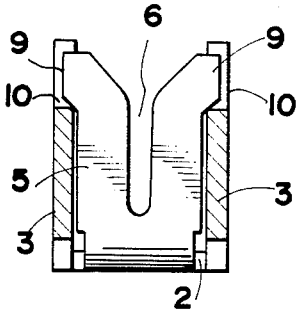
FIG. 3 is a vertical cross sectional view taken along the line A—A in FIG. 2.
Figure 4:
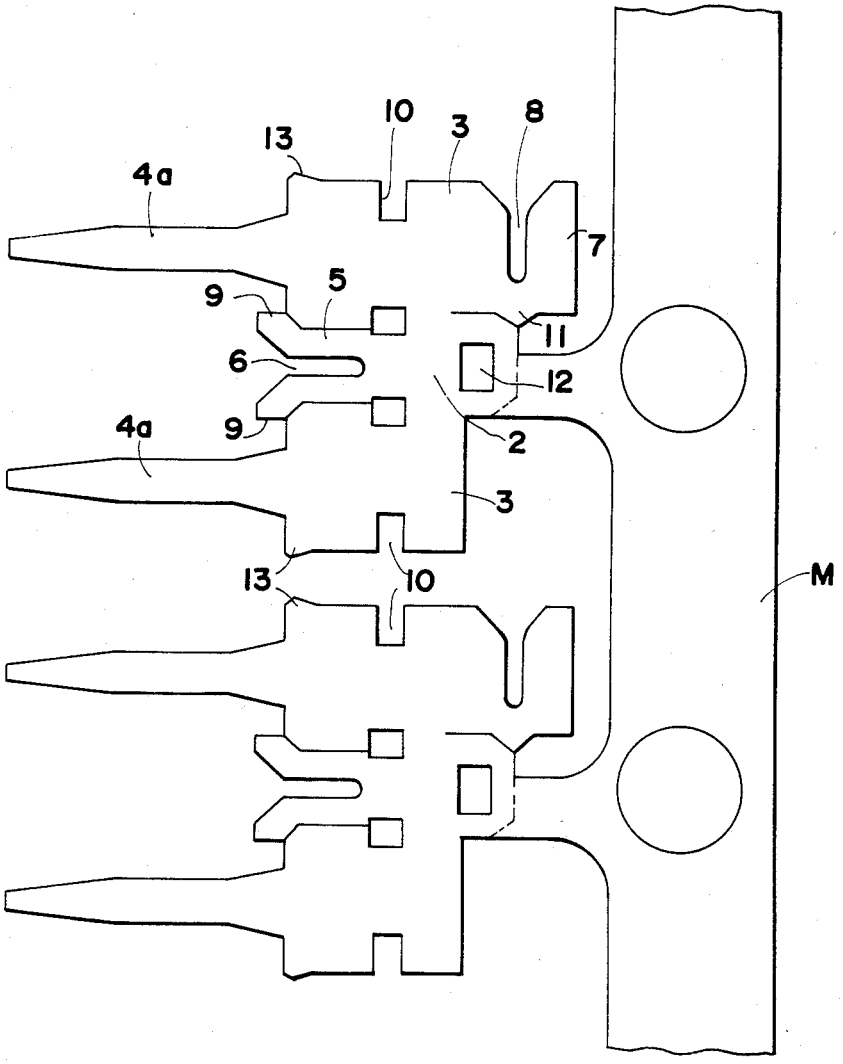
FIG. 4 is an elevational view of the contact of FIG. 1 in a prefolded condition.

A portion 5 is erected or bent so as to form a first contact wall and defines a slot 6 which, as shown most clearly in FIG. 3, is adapted to receive a wire (not shown). One of the side walls 3 is provided with a second contact wall 7, with the second contact wall 7 including a slot 8 adapted to receive a wire (not shown). The first contact wall 5 and second contact wall 7 are bent or fashioned in such a manner that the slots 6, 8 are arranged in alignment with a longitudinally extending axis of the contact body 1.

Each side wall 3 includes a recess 10 which is adapted to receive an ear portion 9 of the first contact wall 5 thereby enabling a securing of the first contact wall 5 in an erected or assembled position. Additionally, by virtue of the engagement of the ear portions 9 in the recesses 10 of the side walls 3, the first contact wall 5 is prevented from being detrimentally expanded laterally or sideways when an insulated clad wire 30 (FIG. 8) is pressed into the slot 6. The second contact wall 7 is provided with a projection 11 which is adapted to be received in a hole or opening 12 (FIG. 2) formed or produced in the bottom wall 2 when the second contact wall is in an erect or assembled position.

Figure 7:
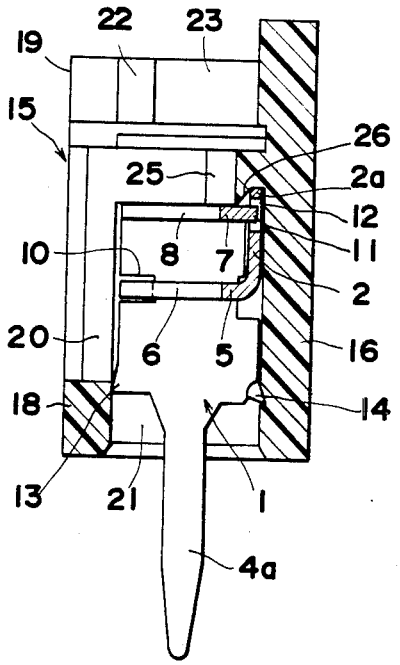
FIG. 7 is a cross sectional view taken along the line C—C in FIG. 5.

As shown most clearly in FIG. 7, the side walls 3 are provided with engaging pawls 13, 14 at a forward position thereof in an area of the tongues 4*a*. The engaging pawls 13, 14 are adapted to abut against a housing generally designated by the reference numeral 15, with the housing 15 being adapted to accommodate a plurality of contact bodies 1. Each of the tongues 4*a*, as shown most clearly in FIG. 1, include a bulging or expanded middle portion 4*b* which enables the connecting section 4 to be securely and firmly connected to a printed circuit board in the manner shown most clearly in FIG. 8.

Figure 5:
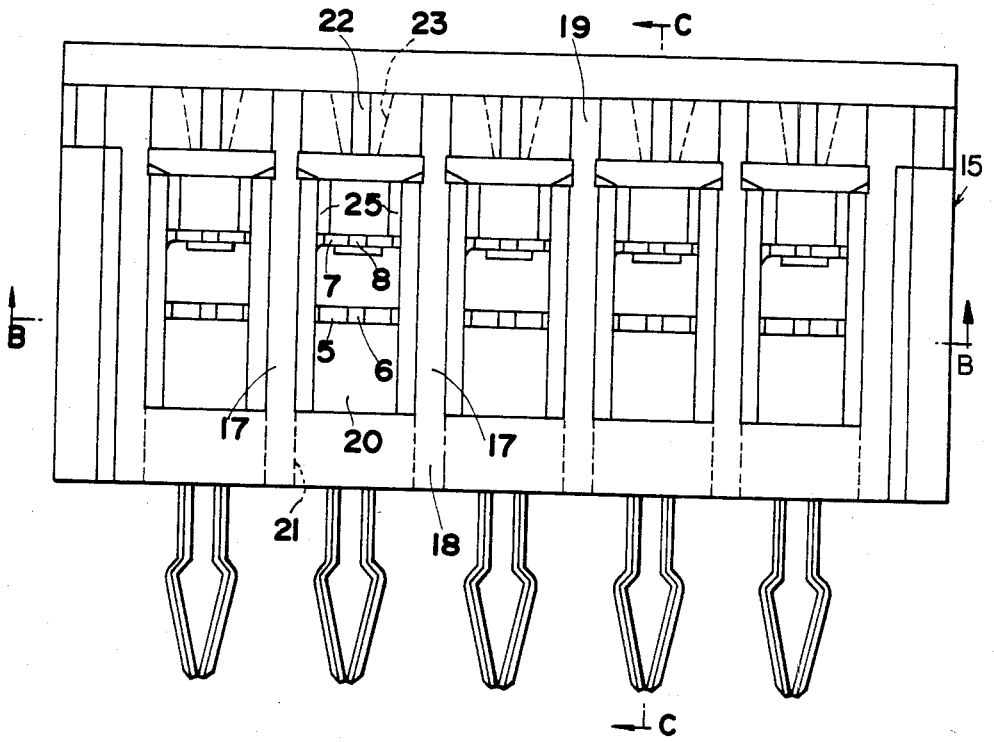
FIG. 5 is a plan view of contacts constructed in accordance with the present invention loaded in a housing of a multi-contact connector.
Figure 6:
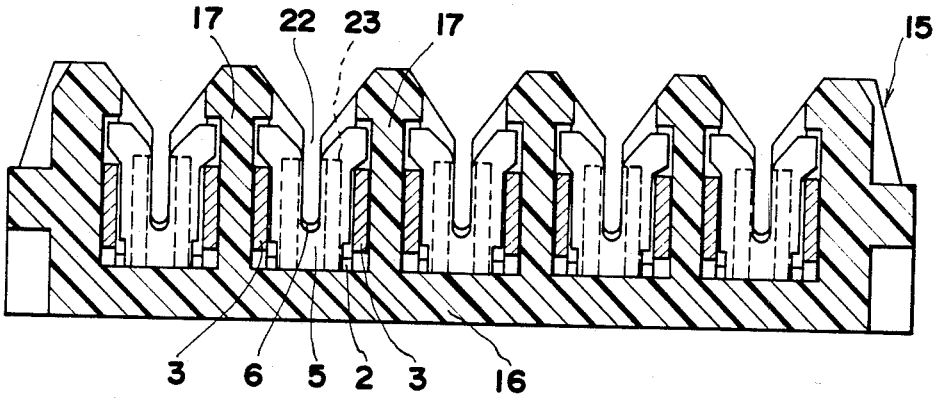
FIG. 6 is a cross sectional view taken along the line B—B in FIG. 5.

As best shown in FIG. 6, the housing 15 is fasioned in one piece of an insulating material such as, for example, nylon or the like and, as shown most clearly in FIG. 6, the housing 15 includes a bottom wall 16 having partitions 17 provided thereon at equal intervals. The partitions 17 are integrally formed with a front wall 18 of the housing 15 and a rear wall 19 of the housing 15. To adjacent partitions 17 constitute or define therebetween a chamber 20 (FIG. 5) for enabling the individual contact bodies 1 to be loaded or accommodated therein.

The front wall 18 is provided with holes 21 each having a shape corresponding to the profile of the connecting section 4 of the contact body 1. The rear wall 19 is provided with slots 22 adapted to allow the individual wires to be engaged therein, with each slot 22 being aligned with the slots 6, 8 of the contact body 1.

Figure 8:
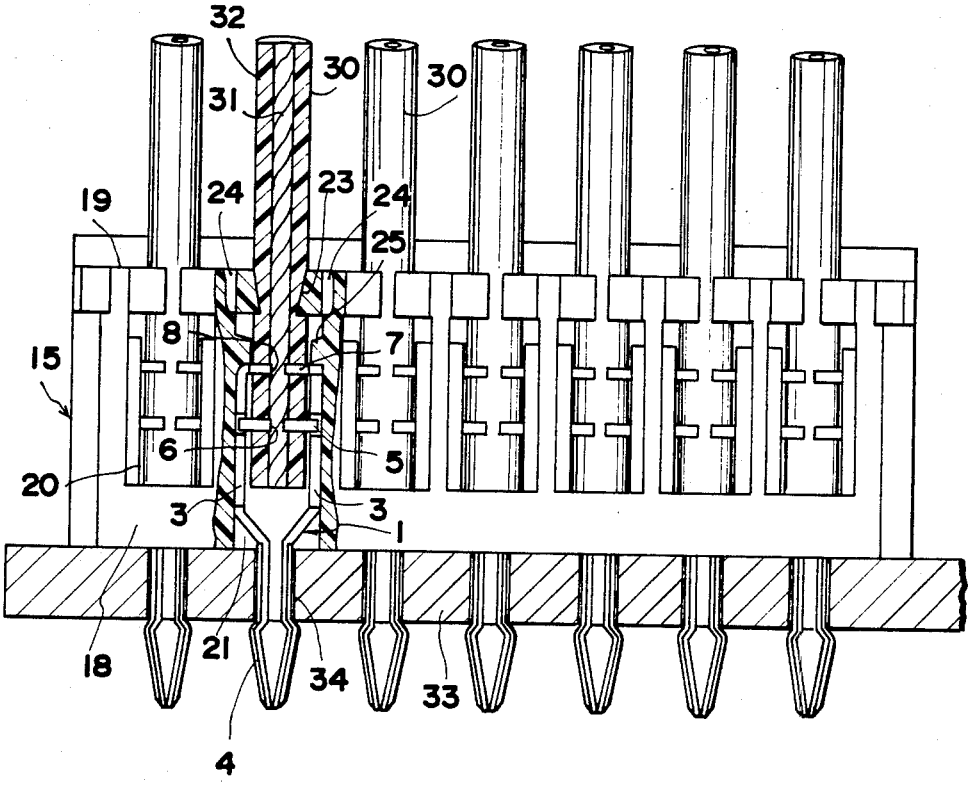
FIG. 8 is a fragmented cross sectional plan view illustrating one exemplary use of a connector constructed in accordance with the present invention.

As shown most clearly in FIGS. 5, 6, and 8, a recess 23, continuously formed with the slot 22, holds wires 30 securely in the slot 22. The chambers 20 adapted to accommodate the contact bodies 1 include projecting walls 25 against which the second contact walls 7 of the contact bodies 1 are abutted when the contact bodies 1 are accommodated in the respective chambers 20. The projecting walls 25 are effective to prevent the respective contact bodies 1 from being displaced along the longitudinal axis of the wire 30 when the connecting section 4 is inserted into a fixture hole 34 in a printed circuit board 33 (FIG. 8). The prevention of an axial or lengthwise displacement of the contact body 1 ensures a firm connection between the wire 30 and the contact body 1.

As shown in FIG. 7, the projecting wall 25 includes a recess 26 at a root or base portion thereof, with the recess 26 being adapted to receive a tail portion 2*a* of the contact body 1. The tail portions 2*a* are of various length and tend to obstruct or block the second contact wall 7 from being exactly abutted with the projecting walls 25. However, due to a sheltering or accommodating of the tail portions 2*a* in the recesses 26, each contact wall 7 securely rests on the projecting walls 25. The engaging pawls 13, 14 are effectively caught or secured in the inside walls of the hole 21 when the connecting section for the contact body 1 is pressed into the hole 21. This arrangement prevents the contact body 1 from being withdrawn from the hole 21 as a result of shock or other forces acting on the contact body 1.

In use, the insulation clad wire 30 is pressed into the chamber 20 through an open top end thereof and is tightly held in the slots 6, 8, 22. Advantageously, a width of the slots 6, 8 is narrower than a diameter of the conductor 31 of the insulation clad wire 30 and side ridges of the slots 6, 8 penetrate into the outer insulation covering 32 of the wire 30 thereby ensuring that the side ridges come into contact with the conductor 31. The wire 30 is held in the recess 23 through the slot 22, wherein tapered side walls of the recess 23 secures a tight holding of the wire 30 and, in this manner, the insulation clad wires 30 are mounted in the respective connector bodies with each contact body 1 being loaded in the printed circuit board 33 by inserting the connection section 44 into the fixture hole 34 of the printed circuit board 33, and the connecting sections then being affixed by, for example, soldering or the like to the printed circuit board 33.

While I have shown and described only one embodiment in accordance with the present invention, it is understood that the same is not limited thereto but is susceptible of numerous changes and modifications as known to one having ordinary skill in the art and I therefore do not wish to be limited to the details shown and described herein, but intend to cover all such modifications as are encompassed by the scope of the appended claims.

I claim:

1. An electrical connector arrangement comprising a housing means, at least one contact means for enabling a connection with an electrical means, the at least one contact means includes an electrical connection section and a holding section for accommodating an electrical conductor means associated with the at least one contact means, the holding section includes first and second spaced side walls and first and second contact walls spaced from each other in a longitudinal direction of the electrical conductor means, each of said contact walls having arranged therein a first slot for accommodating the electrical conductor means in an electrically conductive manner, and a first means provided on at least one of said first and second side walls for preventing a lateral expansion of the slot therein upon an insertion of the electrical conductor means, a second means for preventing said electrical connection from displacing in a longitudinal direction upon insertion of the electrical conductor means, said first means including an ear portion and a recess portion adapted to receive said ear portion, said recess being provided in said first and second side walls, said first and second side walls including pawls at forward corners thereof for enabling a connection with said housing means, said housing means including a second slot in alignment with said first slots, and a hole through which the at least one contact means is accommodated in the housing means, said second means includes projecting walls provided in said housing means against which the contact means is abutted when the same is accommodated in the housing means, said pawls being engaged with said hole thereby securing the contact means to the housing means.

2. An electrical connector arrangement according to claim 1, wherein said at least one contact means is formed as a stamped one piece sheet metal member.

3. An electrical connector arrangement according to claim 2, wherein the electrical means is a printed circuit board and said electrical conductor means is an insulation clad electrical wire.

4. An electrical connector arrangement according to claim 1, wherein a plurality of contact means are provided, said housing means is formed of an insulating material and is adapted to accommodate the plurality of contact means, the housing means includes an opening at one end thereof for enabling an insertion of the contact means therein, a plurality of second slots corresponding in number to the contact means are provided in the housing means for accommodating the electrical conductor means associated with each contact means, said second slots being disposed in substantial alignment with the first slots in said first and second contact walls, and wherein the housing means further includes an opening provided in a front wall thereof for enabling respective electrical connection sections of the contact means to extend therethrough.

5. An electrical connector arrangement according to claim 4, wherein each of said second slots is formed as a downwardly opening recess so as to allow the electrical conductor means to be inserted into the second slots and rest therein.

6. An electrical connector arrangement according to claim 4, wherein each of said plurality contact means is formed as a stamped one piece sheet metal member.

7. An electrical connector arrangement according to claim 6, wherein the electrical means is a printed circuit board and said electrical conductor means is an insulation clad electrical wire.

8. An electrical conductor arrangement according to claim 5, wherein the housing means further includes a plurality of further recesses for accommodating tail portions of the contact means accommodated in the housing means.

9. An electrical connector arrangement according to claim 1, wherein the at least one contact means is formed as a one piece stamped member of an electrically conductive material and includes a bottom wall member from which the spaced side walls extend, said first contact wall being formed as a bent portion extending substantially vertically from the bottom wall member, said second contact wall being formed as a bent portion extending from one of the side wall members, and an opening provided in the bottom wall member for accommodating the second contact wall.

10. An electrical connector arrangement according to claim 9, wherein a plurality of contact members are provided, the housing means is formed of insulating material and is adapted to accommodate the plurality of contact means, and means are provided for dividing the housing means into a plurality of individual contact means accommodating chambers.

11. An electrical connector arrangement according to claim 10, wherein said electrical means is a printed circuit board and said electrical conductor means is an insulation clad electrical wire.

* * * * *